US010490332B2

(12) United States Patent
Kim et al.

(10) Patent No.: US 10,490,332 B2
(45) Date of Patent: Nov. 26, 2019

(54) INDUCTOR

(71) Applicant: SAMSUNG ELECTRO-MECHANICS CO., LTD., Suwon-si, Gyeonggi-do (KR)

(72) Inventors: Jin Seong Kim, Suwon-si (KR); Jae Hyun Kwon, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 41 days.

(21) Appl. No.: 15/725,729

(22) Filed: Oct. 5, 2017

(65) Prior Publication Data

US 2018/0166198 A1 Jun. 14, 2018

(30) Foreign Application Priority Data

Dec. 14, 2016 (KR) ..... 10-2016-0170425

(51) Int. Cl.

| | |
|---|---|
| ***H01F 27/28*** | (2006.01) |
| ***H01F 17/00*** | (2006.01) |
| ***H01F 17/04*** | (2006.01) |
| ***H01F 27/02*** | (2006.01) |
| *H01F 41/04* | (2006.01) |
| *H01F 27/29* | (2006.01) |

(52) U.S. Cl.

CPC ..... *H01F 17/0013* (2013.01); *H01F 17/0033* (2013.01); *H01F 17/04* (2013.01); *H01F 27/022* (2013.01); *H01F 27/292* (2013.01); *H01F 41/046* (2013.01); *H01F 2017/048* (2013.01)

(58) Field of Classification Search

CPC .... H01F 3/08; H01F 17/0013; H01F 17/0033; H01F 17/04; H01F 17/0006; H01F 41/046; H01F 27/022; H01F 27/292; H01F 27/2804; H01F 27/255; H01F 2017/048; H01F 5/003; H01F 2027/2809

USPC ..... 336/200, 233, 192

See application file for complete search history.

(56) References Cited

U.S. PATENT DOCUMENTS

| | | | |
|---|---|---|---|
| 8,610,525 | B2 | 12/2013 | Matsuura et al. |
| 2011/0110014 | A1 | 5/2011 | Hirata et al. |

(Continued)

FOREIGN PATENT DOCUMENTS

| | | | |
|---|---|---|---|
| CN | 102915825 | A | 2/2013 |
| CN | 103093947 | A | 5/2013 |

(Continued)

OTHER PUBLICATIONS

Notice of Office Action dated Jul. 25, 2018 in corresponding Korean Application No. 10-2016-0170425, including English translation (15 pages).

(Continued)

*Primary Examiner* — Mang Tin Bik Lian

(74) *Attorney, Agent, or Firm* — Morgan, Lewis & Bockius LLP

(57) ABSTRACT

An inductor includes a body having a coil portion disposed therein, and a protective layer disposed on a surface of the body. The body includes an active portion in which a coil portion is disposed, and a cover portion disposed on upper and lower surfaces of the coil portion. A grain size in the protective layer is greater than a grain size in the body.

28 Claims, 5 Drawing Sheets

(56) References Cited

U.S. PATENT DOCUMENTS

| | | | | |
|---|---|---|---|---|
| 2011/0141655 | A1* | 6/2011 | Jeong | H01G 4/005 361/303 |
| 2013/0033347 | A1* | 2/2013 | Matsuura | H01F 17/0013 336/83 |
| 2013/0113593 | A1 | 5/2013 | Jeong et al. | |
| 2013/0147591 | A1* | 6/2013 | Kim | H01F 17/04 336/200 |
| 2013/0222101 | A1* | 8/2013 | Ito | H01F 17/04 336/83 |
| 2014/0022692 | A1* | 1/2014 | Yoon | H01G 4/12 361/301.4 |
| 2014/0118100 | A1* | 5/2014 | Sato | H01F 17/0013 336/200 |
| 2014/0145816 | A1 | 5/2014 | Sato et al. | |
| 2014/0333404 | A1 | 11/2014 | Bae et al. | |
| 2016/0086714 | A1 | 3/2016 | Moon et al. | |
| 2016/0260535 | A1* | 9/2016 | Kubota | H01F 17/0013 |
| 2016/0276089 | A1* | 9/2016 | Inoue | B22F 7/04 |
| 2017/0330673 | A1* | 11/2017 | Sato | H01F 27/255 |

FOREIGN PATENT DOCUMENTS

| | | | |
|---|---|---|---|
| CN | 103827991 | A | 5/2014 |
| JP | 2001-217550 | A | 8/2001 |
| JP | 2007-173480 | A | 7/2007 |
| JP | 2009-032833 | A | 2/2009 |
| JP | 2010-080703 | A | 4/2010 |
| JP | 2013-55315 | A | 3/2013 |
| KR | 10-2011-0018936 | A | 2/2011 |
| KR | 10-2013-0016033 | A | 2/2013 |
| KR | 10-2014-0012493 | | 2/2014 |
| KR | 10-2015-0005292 | A | 1/2015 |
| KR | 10-1580411 | B1 | 12/2015 |
| KR | 10-2015-0106742 | | 4/2016 |
| WO | 2010146967 | A | 7/2010 |

OTHER PUBLICATIONS

Korean Office Action issued in corresponding Korean Patent Application No. 10-2016-0170425, dated Feb. 6, 2018, with English Translation.

Notice of Office Action issued in Japanese Patent Application No. 2017-193329, dated Jul. 3, 2018 (English translation).

Office Action issued in Chinese Patent Application No. 201711190262.9 dated Jul. 3, 2019, with English translation.

* cited by examiner

Replacement Drawing Sheet

II - II'

I - I'

II - II'

INDUCTOR

CROSS-REFERENCE TO RELATED APPLICATION(S)

This application claims benefit of priority to Korean Patent Application No. 10-2016-0170425 filed on Dec. 14, 2016 in the Korean Intellectual Property Office, the disclosure of which is incorporated herein by reference in its entirety.

BACKGROUND

1. Field

The present disclosure relates to an inductor.

2. Description of Related Art

Inductors, implemented as chip electronic components, are typical passive elements for removing noise by forming electronic circuits together with resistors and capacitors.

Laminated inductors have a structure in which a plurality of insulating layers on which conductor patterns are formed are laminated, the conductor patterns being sequentially connected by conductive vias formed in the respective insulating layers to form coils having a helical structure while being superimposed in a lamination direction. Both ends of the coils are drawn out to external surfaces of laminates to be connected to external terminals.

However, in recent years, information technology (IT) products have come to include various functions due to rapid technological development. Particularly, as miniaturization and thinning progress, problems of cracking and reliability of inductor bodies continue to occur.

In addition, in general inductors, in a case in which the sinterability of bodies is increased, problems such as body cracking or the like may occur, and it may be difficult to obtain good frequency characteristics due to stress.

On the other hand, in a case in which the sinterability of the bodies is lowered in order to obtain good frequency characteristics in the inductors, formation of external electrodes on the exteriors of the bodies may result in lower reliability due to penetration of a plating solution and lowering of the strength of the bodies.

Therefore, research into a method for obtaining good frequency characteristics in inductors and preventing the deterioration of reliability thereof due to penetration of a plating solution and cracking of the bodies is needed.

SUMMARY

An aspect of the present disclosure is to provide an inductor having improved reliability.

According to an aspect of the present disclosure, an inductor includes a body having a coil portion disposed therein, and a protective layer disposed on a surface of the body. The body includes an active portion in which a coil portion is disposed, and cover portions disposed on upper and lower surfaces of the coil portion. A grain size in the protective layer is greater than a grain size in the body.

According to another aspect of the present disclosure, an inductor includes a body having a coil portion disposed therein, and a protective layer disposed on a surface of the body. The body includes an active portion in which the coil portion is disposed, and cover portions disposed on upper and lower surfaces of the coil portion. A grain size (Ga) in the active portion, a grain size (Gb) in the cover portion, and a grain size (Gc) in the protective layer satisfy Ga<Gb<Gc.

According to a further aspect of the present disclosure, an inductor includes a body comprising a ceramic material having a first grain size, a coil disposed within the body, and a protective layer disposed on the body and comprising a ceramic material having a second grain size greater than the first grain size.

BRIEF DESCRIPTION OF DRAWINGS

The above and other aspects, features, and advantages of the present disclosure will be more clearly understood from the following detailed description when taken in conjunction with the accompanying drawings, in which.

DETAILED DESCRIPTION

Figure 1:
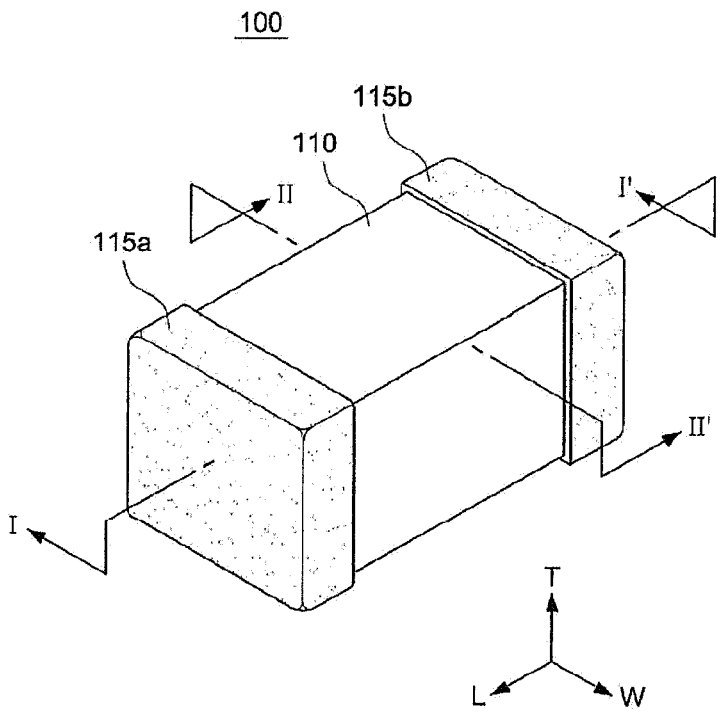
FIG. 1 is a schematic perspective view of an inductor according to an exemplary embodiment.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region, or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers, and/or sections, these members, components, regions, layers, and/or sections should not be construed as being limited by these terms. These terms are only used to distinguish one member, component, region, layer, or section from another member, component, region, layer, or section. Thus, a first member, component, region, layer, or section discussed below could be termed a second member, component, region, layer, or section without departing from the teachings of the embodiments.

Spatially relative terms, such as "above," "upper," "below," and "lower" and the like, may be used herein for ease of description to describe one element's positional relationship relative to other element (s) in the orientation shown in the figures. It will be understood that the spatially relative terms are intended to encompass different orientations of the device in use or operation in addition to the orientation depicted in the figures. For example, if the device in the figures is turned over, elements described as "above" or "upper" relative to other elements would then be oriented "below" or "lower" relative to the other elements or features. Thus, the term "above" can encompass both upward and downward orientations, depending on a particular direction of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views shown in the drawings and illustrating embodiments of the present disclosure. In the drawings, components having ideal shapes are shown. However, variations from these ideal shapes, for example due to variability in manufacturing techniques and/or tolerances, also fall within the scope of the disclosure. Thus, embodiments of the present disclosure should not be construed as being limited to the particular shapes of regions shown herein, but should more generally be understood to include changes in shape resulting from manufacturing methods and processes. The following embodiments may also be constituted by one or a combination thereof.

The contents of the present disclosure described below may have a variety of configurations and illustrative configurations are proposed herein. The disclosure should not be interpreted as being limited to the particular illustrative configurations shown and described.

Inductor

Hereinafter, an inductor according to an exemplary embodiment will be described, with a thin film inductor, but embodiments in the present disclosure are not limited thereto.

Figure 2:
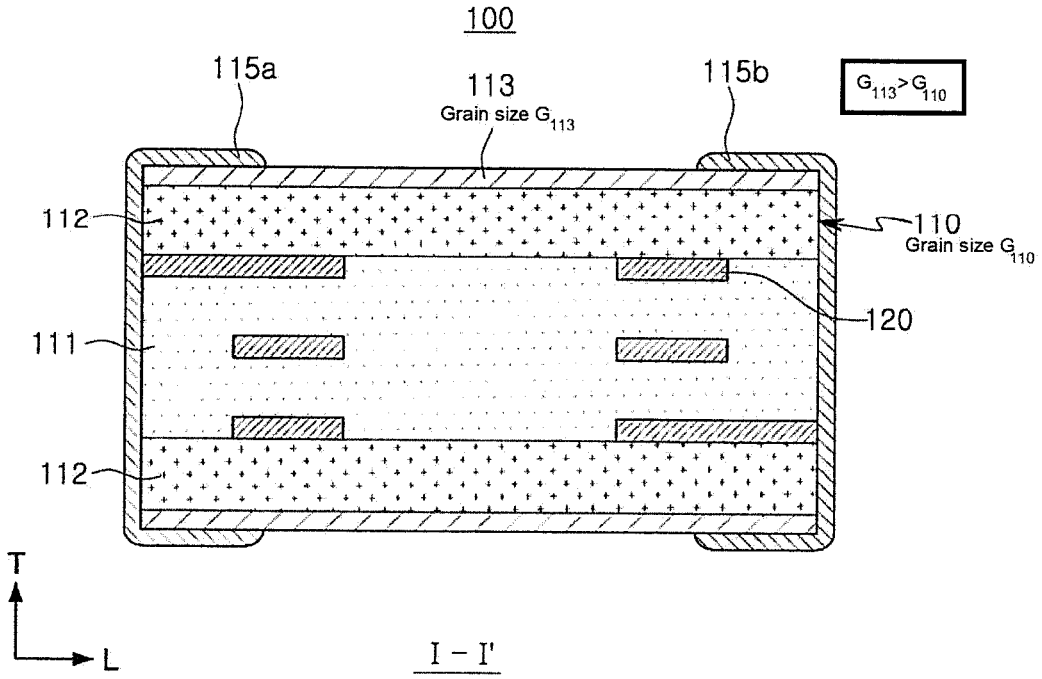
FIG. 2 is a cross-sectional view taken along line I-I' in FIG. 1.
Figure 3:
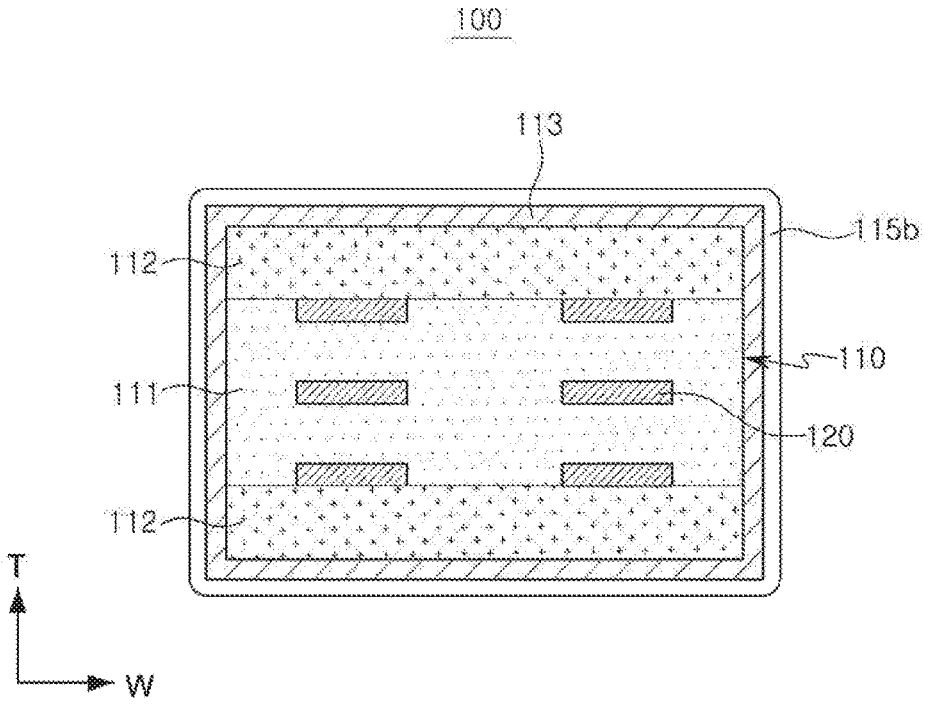
FIG. 3 is a cross-sectional view taken along line II-II' in FIG. 1.
Figure 4:
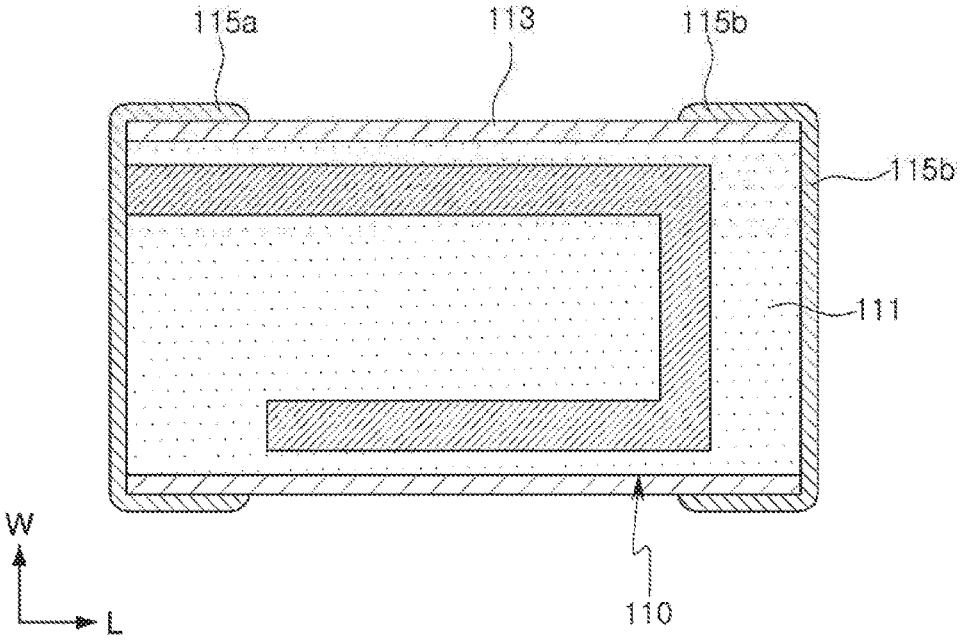
FIG. 4 is a cross-sectional view of the inductor of FIG. 1 taken along a length-width planar direction (LW) in FIG. 1.

FIG. 1 is a schematic perspective view illustrating an inductor according to an exemplary embodiment. FIG. 2 is a cross-sectional view taken along line I-I' in FIG. 1. FIG. 3 is a cross-sectional view taken along line II-II' in FIG. 1. FIG. 4 is a cross-sectional view of the inductor of FIG. 1 taken along a length-width (LW) planar direction.

Referring to FIGS. 1 to 4, as an example of an inductor, a multilayer inductor 100 used in a power supply line of a power supply circuit may be provided.

An inductor 100 according to an exemplary embodiment may include a body 110, a coil portion 120 embedded in the body 110, a protective layer 113 disposed on a surface of the body 110, and external electrodes 115*a* and 115*b* disposed on external surfaces of the body 110 to be electrically connected to the coil portion 120.

In the case of the inductor 100 according to an exemplary embodiment, a 'length' direction is defined as an 'L' direction, a 'width' direction is defined as a 'W' direction, and a 'thickness' direction is defined as a 'T' direction in FIG. 1.

Referring to FIGS. 2 and 3, the body 110 may be configured by a ceramic laminate formed by laminating a plurality of ceramic layers, and internal electrodes may be disposed on the plurality of ceramic layers and the internal electrodes may be connected to each other by vias, thereby forming the coil portion 120.

The ceramic layers constituting the body 110 may be formed of, but are not limited to, a dielectric substance, and may be mainly composed of a magnetic substance, although not being limited thereto.

In an exemplary embodiment, ferrite may be used as a magnetic material, and the ferrite may be appropriately selected according to magnetic properties to be achieved by an electronic component. For example, ferrite having a relatively high specific resistance and relatively low loss may be used.

Although not limited thereto, Ni—Zu—Cu ferrite may be used, and a dielectric having a dielectric constant of 5 to 100 may be used.

In addition, as a nonmagnetic dielectric material, a ceramic material formed of zirconium silicate, zirconate potassium, zirconium, or the like, may be used, but is not limited thereto.

On the other hand, the body 110 may also include a magnetic metal powder. The magnetic metal powder may include at least one selected from the group consisting of iron (Fe), silicon (Si), chromium (Cr), aluminum (Al), and nickel (Ni), and may be, for example an Fe—Si—B—Cr amorphous metal, but is not necessarily limited thereto.

The body 110 may further include a thermosetting resin, and the magnetic metal powder particles may be dispersed in a thermosetting resin such as an epoxy resin, a polyimide resin, or the like.

A plurality of internal electrodes constituting the coil portion 120 may be disposed on the ceramic layers. The internal electrodes may be formed inside the body 110, to allow electricity to be applied thereto and thus implement inductance or impedance.

The coil portion 120 and the via may be formed to include a metal having excellent electrical conductivity, and for example, may be formed of one selected from the group consisting of silver (Ag), palladium (Pd), aluminum (Al), nickel (Ni), titanium (Ti), gold (Au), copper (Cu), platinum (Pt), alloys thereof, and the like.

The body 110 may further include a sintering agent to implement shrinkage matching during a simultaneous sintering process.

The sintering agent may be one or more selected from the group consisting of $B_2O_3$, CuO, and $LiBO_2$, and may be included in an amount of 1 to 5 parts by weight based on 100 parts by weight of a compound.

One end of the coil portion 120 may be exposed to one end surface of the body 110 in a length (L) direction and the other end of the coil portion 120 may be exposed to the other end surface of the body 110 in the length (L) direction.

External electrodes 115*a* and 115*b* may be formed on both end surfaces of the body 110 opposing each other in the length (L) direction, to be connected to the coil portion 120 exposed to both end surfaces of the body 110 in the length (L) direction.

The external electrodes 115*a* and 115*b* may include a conductive resin layer and a plating layer formed on the conductive resin layer.

The conductive resin layer may include at least one conductive metal selected from the group consisting of copper (Cu), nickel (Ni), and silver (Ag), and a thermosetting resin.

The conductive resin layer may include an epoxy resin.

The plating layer may include one or more selected from the group consisting of nickel (Ni), copper (Cu), and tin (Sn), and may be formed by sequentially laminating, for example, a nickel (Ni) layer and a tin (Sn) layer.

In the case of IT products, various functions have been generally included due to rapid technological development, and furthermore, as IT products have been miniaturized and slimmed, reliability issues such as cracking of an inductor body have continuously occurred.

In addition, in the case of a general inductor, if sinterability of the body is increased, a problem such as cracking of a body may occur, and it may be difficult to obtain good frequency characteristics due to stress.

On the other hand, if the sinterability of the body is lowered to obtain good frequency characteristics of the inductor, when an external electrode is formed on an external surface of the body, a problem in which reliability is lowered due to penetration of a plating solution and a decrease in strength of the body may occur.

According to an exemplary embodiment, the problems described above may be solved by forming the protective layer 113 on a surface of the body 110 and adjusting a grain size $G_{113}$ in the protective layer 113 to be greater than the grain size $G_{110}$ in the body 110: $G_{113}>G_{110}$.

A grain size in the protective layer 113 after sintering may be adjusted to be greater than a grain size in the body 110. Due to the protective layer 113 having a relatively large (e.g., greater) grain size, a density may be improved, and thus, penetration of the plating solution may be reduced and strength of the body 110 may be improved. Due to the body 110 having a relatively small grain size, stress may be improved, and as a result, frequency characteristics may be improved.

As used herein, a grain size may refer to an average grain size of layer or region. More generally, the grain size may refer to a minimum grain size, a maximum grain size, a median grain size, or a threshold ensuring that 90% or more (or 95% or more) of particles in the layer or region have a grain size exceeding (or, alternatively, below), the cited size.

The protective layer 113 may include the same ceramic material as the ceramic material included in the body 110.

For example, the protective layer 113 may be formed of, but not limited to, a dielectric material, in a manner similar to the case of a ceramic material constituting the body 110, and may also be mainly formed of a magnetic material, although not being limited thereto.

For example, when the protective layer 113 includes a magnetic material, ferrite may be used. Although the ferrite may be appropriately selected according to magnetic properties to be achieved by an electronic component, ferrite having a relatively high specific resistance and relatively low loss may be used. For example, Ni—Zu—Cu ferrite may be used, and a dielectric having a dielectric constant of 5 to 100 may be used, but an exemplary embodiment is not limited thereto.

In addition, when the protective layer 113 includes a non-magnetic dielectric material, a ceramic material such as zirconium silicate, zirconate potassium, zirconium, or the like may be used, but is not limited thereto.

Although not particularly limited, a method of adjusting a grain size in the protective layer 113 to be greater than a grain size in the body 110 may be performed by adjusting a content of a sintering aid contained in the ceramic material used for the formation of the body 110 and the protective layer 113.

For example, by applying different contents of the sintering aid to the body 110 and the protective layer 113 to control a degree of sintering, the grain size in the protective layer 113 may be greater than the grain size in the body 110 after sintering.

According to an exemplary embodiment, the grain size in the protective layer 113 may be 1.5 μm or more.

A grain size in the protective layer 113 may be 1.5 μm or more, and a grain size in the body 110 may be less than a grain size in the protective layer 113.

In addition, the grain size in the body 110 may be less than 1.5 μm, and the grain size in the protective layer 113 may be greater than the grain size in the body 110.

The grain size in the protective layer 113 may be greater than the grain size in the body 110, and the grain size in the protective layer 113 and the grain size in the body 110 may be different from each other. For example, when the grain size in the protective layer 113 is 1.5 μm, the grain size in the body 110 may be less than 1.5 μm.

As described above, the grain size in the protective layer 113 is adjusted to be greater than the grain size in the body 110, thereby implementing an inductor having improved reliability and excellent frequency characteristics.

Porosity of the protective layer 113 may be lower than porosity of the body 110. For example, a density of a ceramic material in the protective layer 113 may be higher than that of a ceramic material in the body 110, and thus, the porosity of the protective layer 113 may be lower than that of the body 110.

The protective layer 113 may have an average thickness of 0.1 μm to 50 μm. In some examples, the protective layer 113 may have an average thickness of 10 μm to 20 μm.

By adjusting the average thickness of the protective layer 113 to 0.1 μm to 50 μm or, in some examples, 10 μm to 20 μm, penetration of a plating solution may be prevented and strength of the inductor may be improved.

If the average thickness of the protective layer 113 is less than 10 μm, an effect of preventing penetration of the plating solution and improving strength of the inductor may not be obtained.

On the other hand, if the average thickness of the protective layer exceeds 20 μm (while the overall size of the inductor 100 remains constant), since a volume of an active portion 111 in which the coil portion 120 is disposed decreases by an amount exceeding the above range, inductance may decrease.

According to an exemplary embodiment, the body 110 may include the active portion 111 in which the coil portion 120 is disposed, and cover portions 112 disposed on upper and lower surfaces of the coil portion 120.

The cover portions 112, for example, upper and lower cover portions, may be formed of the same material as a ceramic material included in the active portion 111.

The upper and lower cover portions 112 may be formed by laminating a single dielectric layer or two or more ceramic layers on upper and lower surfaces of the active portion 111 in a vertical direction. The upper and lower cover portions 112 may basically prevent damage to the coil portion 120 due to physical or chemical stress.

In the case of a general inductor, internal residual stress due to a difference in a shrinkage ratio after sintering the body may remain in the body, resulting in deterioration of impedance characteristics of the inductor.

The internal residual stress described above may be caused by stress between a coil portion and a body, which may be considered as stress due to a difference in shrinkage ratio between an active portion and a cover portion.

According to an exemplary embodiment in the present disclosure, the problem as above may be solved by adjusting a grain size in the cover portion 112 to be greater than a grain size in the active portion 111.

For example, by adjusting the grain size in the cover portion 112 to be greater than the grain size in the active portion 111, stress that may be caused by a difference in a shrinkage ratio between the active portion and the cover portion may be relieved to improve impedance characteristics.

The method of adjusting a grain size in the cover portion 112 to be greater than a grain size in the active portion 111 is not particularly limited. The method may be performed, for example, by adjusting a content of a sintering aid contained in a ceramic material used for formation of the active portion 111 and the cover portion 112.

For example, by differently applying the ceramic material used for the active portion 111 and the cover portion 112 thereto, a degree of sintering may be controlled so that the grain size in the cover portion 112 after sintering is greater than the grain size in the active portion 111.

Thus, inconsistency in the degree of sintering between the active portion 111 and the cover portion 112 during body sintering may be reduced, thereby improving impedance characteristics.

Porosity of the cover portion 112 may be lower than that of the active portion 111.

Referring to FIGS. 2 to 4, the protective layer 113 according to an exemplary embodiment may be formed on upper and lower surfaces of the body 110, opposing each other in a thickness (T) direction, and on both sides of the body 110 opposing each other in a width (W) direction.

According to an exemplary embodiment, the protective layer 113 may be formed on the upper and lower surfaces of the body 110, opposing each other in the thickness (T) direction, and on both sides of the body 110, opposing each other in the width (W) direction. The protective layer 113 may not be formed on both end surfaces of the body 110, opposing each other in a length (L) direction. Thus, in this case, the volume of the body 110 may not be increased by a thickness of the protective layer 113 in both end surfaces of the body 110, opposing each other in the length (L) direction, as compared with other embodiments in the present disclosure to be described later. As a result, inductance may be improved.

The protective layer 113 may further include an insulating filler used to provide insulation.

The insulating filler may be one or more selected from the group consisting of silica ($SiO_2$), titanium dioxide ($TiO_2$), alumina, glass, and barium titanate powder.

The insulating filler may have a spherical shape, a flake shape or the like, to improve compactness.

Figure 5:
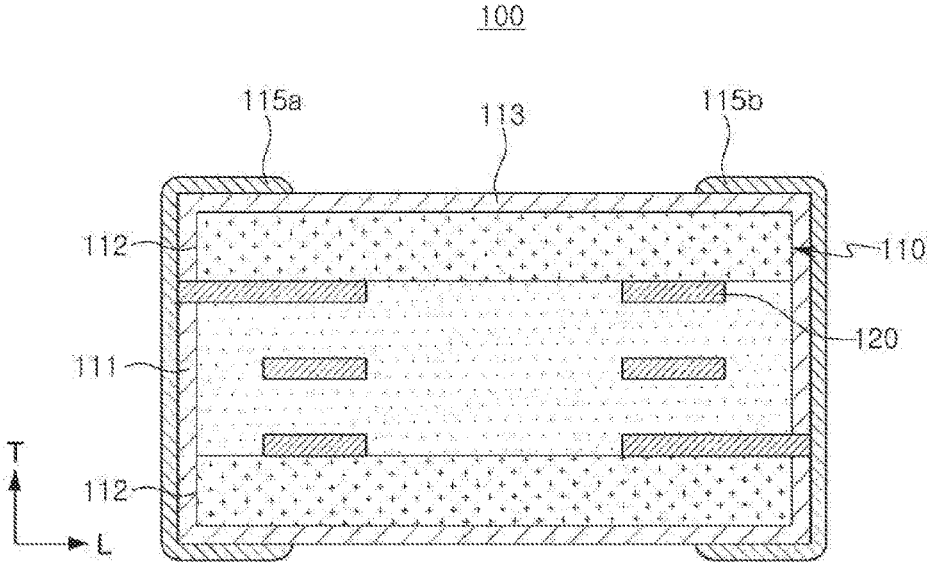
FIG. 5 is a cross-sectional view of an inductor taken along line I-I' in FIG. 1 according to another exemplary embodiment.
Figure 6:
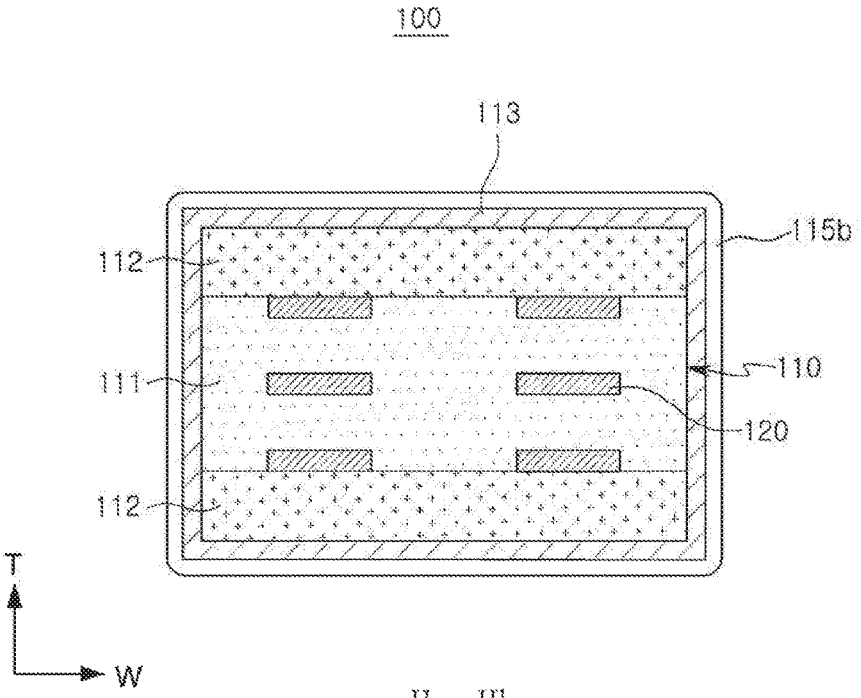
FIG. 6 is a cross-sectional view of an inductor taken along line II-II' in FIG. 1 according to the other exemplary embodiment.
Figure 7:
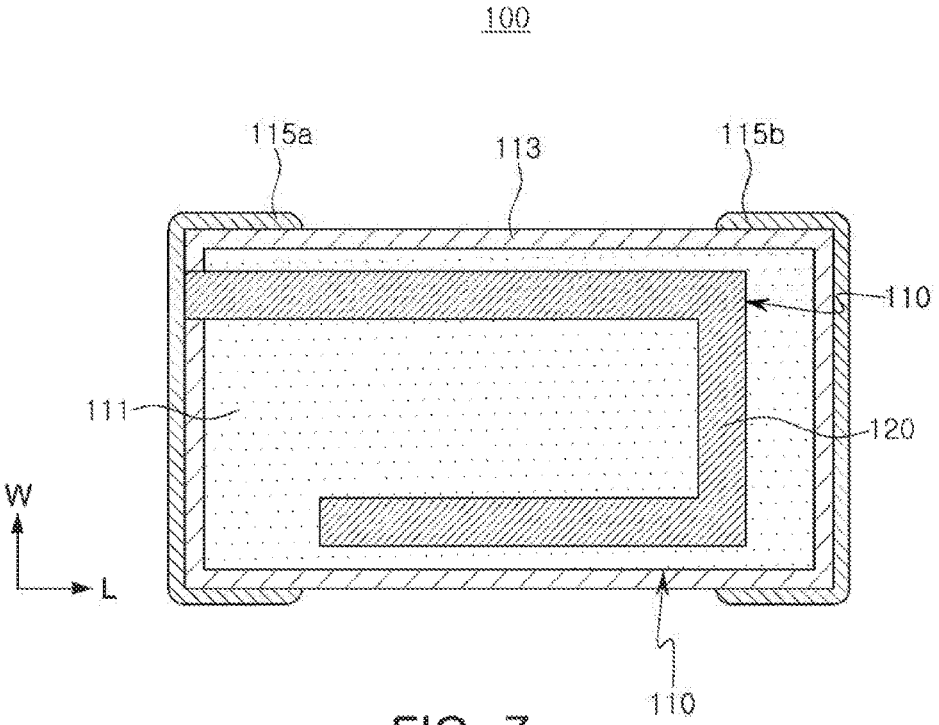
FIG. 7 is a cross-sectional view taken along a length-width planar direction (LW) of FIG. 1 according to the other exemplary embodiment.

FIG. 5 is a cross-sectional view taken along line I-I' of FIG. 1 according to another exemplary embodiment. FIG. 6 is a cross-sectional view taken along line II-II' of FIG. 1 according to the other exemplary embodiment. FIG. 7 is a cross-sectional view of the inductor 100 of FIG. 1 in an LW direction, according to the other exemplary embodiment.

Referring to FIGS. 5 to 7, a protective layer 113 according to another exemplary embodiment may be formed on upper and lower surfaces of a body 110, opposing each other in a thickness (T) direction, on both sides of the body 110, opposing each other in a width (W) direction, and on both end surfaces of the body 110, opposing each other in a length (L) direction.

In this case, ends of a coil portion 120 exposed to both end surfaces of the body 110 opposing each other in the length (L) direction may penetrate through the protective layer 113 to be exposed externally. Alternatively, portions of the protective layer 113 corresponding to ends of the coil portion 120 may be polished to be removed and thus be connected to external electrodes 115*a* and 115*b*.

Since the protective layer 113 according to the exemplary embodiment of FIGS. 5-7 may be formed on the upper and lower surfaces of the body 110, opposing each other in the thickness (T) direction, on both sides of the body 110, opposing each other in the width (W) direction, and on both end surfaces of the body 110, opposing each other in the length (L) direction, an effect of preventing a deterioration in reliability caused by penetration of a plating solution may be relatively excellent, as compared with the exemplary embodiment described above in relation to FIGS. 2-4 in which the protective layer 113 is not formed on both end surfaces of the body, opposing each other in the length (L) direction.

In addition, since the protective layer 113 according to the exemplary embodiment of FIGS. 5-7 may be formed on the upper and lower surfaces of the body 110, opposing each other in the thickness (T) direction, on both sides of the body 110, opposing each other in the width (W) direction, and on both end surfaces of the body 110, opposing each other in the length (L) direction, the effect of improving the strength of the inductor may also be excellent.

Figure 8:
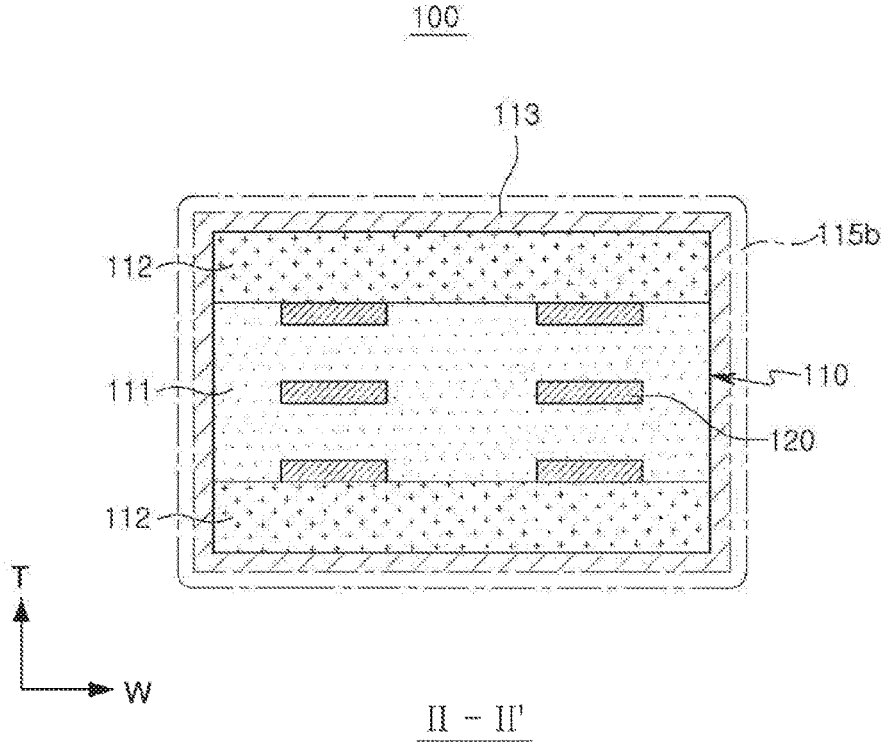
FIG. 8 is a cross-sectional view taken along line II-II' of FIG. 1 according to a further exemplary embodiment.

FIG. 8 is a cross-sectional view taken along line II-II' of FIG. 1 according to a further exemplary embodiment.

Referring to FIG. 8, an inductor according to another further exemplary embodiment may include a body 110 having a coil portion 120 disposed therein, and a protective layer 113 disposed on a surface of the body 110. The body 110 may include an active portion 111 in which the coil portion 120 is disposed, and cover portions 112 disposed on upper and lower surfaces of the coil portion 120. When a grain size of the active portion 111 is Ga, a grain size of the cover portion 112 is Gb, and a grain size of the protective layer 113 is Gc, $Ga<Gb<Gc$ may be satisfied.

According to another exemplary embodiment, when a grain size of the active portion 111 is Ga, a grain size of the cover portion 112 is Gb, and a grain size of the protective layer 113 is Gc, by adjusting grain sizes to satisfy $Ga<Gb<Gc$, an inductor having improved reliability and excellent frequency characteristics may be implemented, and impedance characteristics of the inductor may be improved.

For example, by adjusting the grain size in the protective layer 113 to be greater than the grain size in the active portion 111 and the cover portion 112 constituting the body 110, while the protective layer 113 is disposed on surfaces of the body 110, an inductor having improved reliability and excellent frequency characteristics may be implemented.

In detail, as the grain size in the protective layer 113 after the sintering is adjusted to be greater than the grain size in the active portion 111 and the cover portion 112 constituting the body 110, the structure of the protective layer 113 having a relatively larger (e.g., greater) grain size may prevent penetration of a plating solution and improve the strength of the body. Further, the structure of the body 110 having a relatively small grain size may improve frequency characteristics by reduced stress.

In addition, stress between the cover portion 112 and the active portion 111 may be relieved by adjusting the grain size of the cover portion 112 disposed in the body 110 to be greater than the grain size in the active portion 111. As a result, impedance characteristics of the inductor may be improved.

In addition, overlapping portions in the descriptions of the structure of the inductor according to the exemplary embodiment described above and other exemplary embodiments will be omitted.

Method of Manufacturing Inductor

In a method of manufacturing an inductor according to an exemplary embodiment, first, a plurality of ceramic layers may be prepared.

The ceramic layer may be formed of a magnetic material as an insulating material, and may be formed of a non-magnetic material in a case in which a gap layer is formed.

According to an exemplary embodiment, ferrite may be used as the magnetic material. The ferrite may be appropriately selected according to magnetic properties to be achieved by an electronic component. For example, ferrite having a relatively high specific resistance and relatively low loss may be used. As an example, Ni—Zn—Cu ferrite may be used as the magnetic material, although not being limited thereto.

An internal electrode may be formed on the ceramic layer. The internal electrode may be formed of a conductor material, and a material having relatively low resistivity and low cost may be used. The internal electrode may be formed of one or more of silver (Ag), platinum (Pt), palladium (Pd), Gold (Au), copper (Cu), and nickel (Ni), or alloys thereof, although not being limited thereto.

The internal electrodes formed on the ceramic layers may be connected to each other by vias, to form a coil portion.

A body may be formed, by laminating a plurality of ceramic layers on which the internal electrodes are formed, and by laminating a plurality of ceramic layers on which the internal electrodes are not formed, on upper and lower portions of the coil portions.

The plurality of ceramic layers on which the internal electrodes are formed may be laminated to form an active portion, and the plurality of ceramic layers on which the internal electrodes are not formed may be laminated on the upper and lower portions of the coil portion to form a cover portion.

As the plurality of ceramic layers on which the internal electrodes constituting the active portion are formed, and the plurality of ceramic layers on which the internal electrodes constituting the cover portion are not formed, are configured to include different ceramic materials, the grain sizes in the sintered body may be adjusted to be different from each other.

In detail, as sintering aids contained in the ceramic layer constituting the active portion and the ceramic layer constituting the cover portion have different materials and contents, the grain size in the cover portion may be adjusted to be greater than the grain size in the active portion, after sintering.

Subsequently, a protective layer containing a ceramic material may be formed on surfaces of the body.

The protective layer may be disposed on both sides of the body in a width direction and on upper and lower surfaces of the body in a thickness direction, and may also be disposed on all surfaces (e.g., the entirety) of the body.

The grain size in the protective layer may be greater than the grain size in the body, by controlling a material and a content of the sintering aid in the ceramic material contained in the protective layer, to be different from a material and a content of the sintering aid in the body.

In a final stage, an external electrode may be formed by applying an external electrode forming paste on an external surface of the body on which the protective layer has been disposed.

Figure 9:
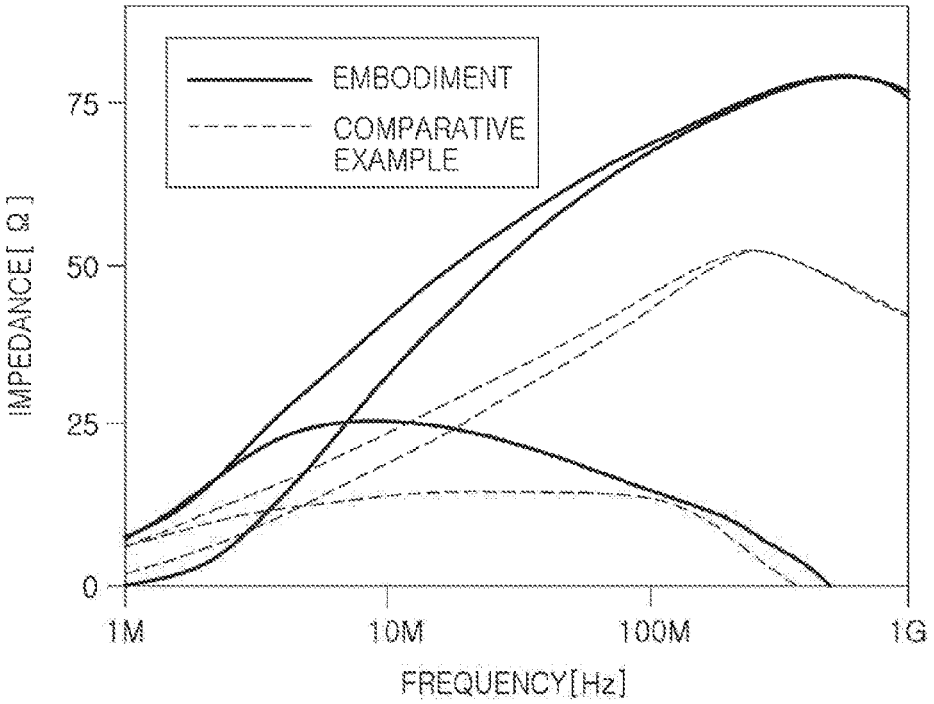
FIG. 9 is a graph illustrating changes in impedance according to a frequency in an exemplary embodiment and a comparative example according to the related art.

FIG. 9 is a graph illustrating changes in impedance according to frequency of an exemplary embodiment of the present disclosure and a comparative example of the related art.

Referring to FIG. 9, the exemplary embodiment illustrates a case in which a protective layer including ceramic grains having a grain size greater than a grain size of the body is disposed on a surface of a body according to an exemplary embodiment, and the comparative example illustrates the related art case in which a protective layer is not disposed on a surface of a body.

As illustrated in the graph of FIG. 9, in the exemplary embodiment of the present disclosure in which the protective layer including the ceramic grain having the grain size greater than the grain size of the body is disposed on the surface of the body, it may be seen that noise removing ability has been improved as compared with the comparative example of the related art.

Figure 10:
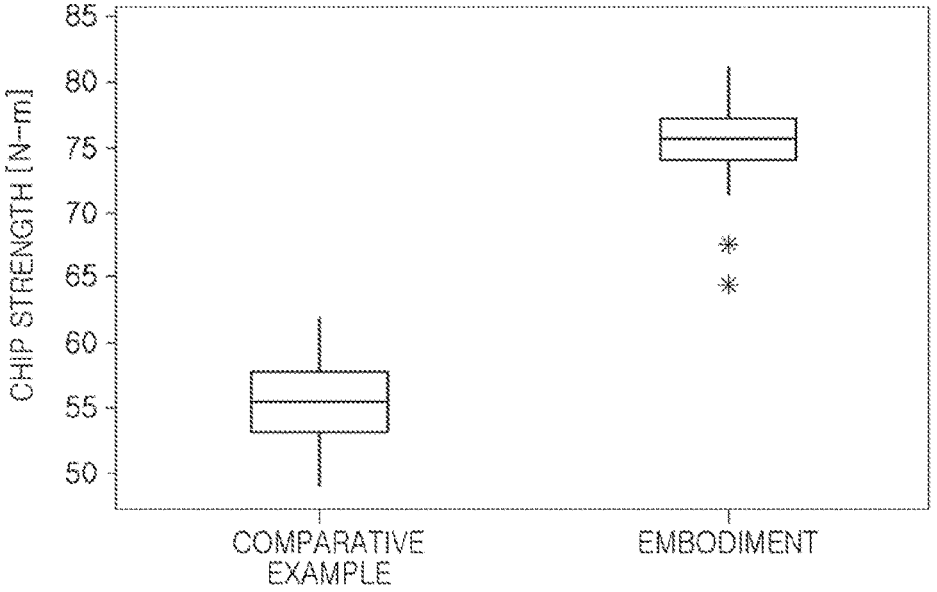
FIG. 10 is a graph comparing the strength of inductors according to an exemplary embodiment and a comparative example.

FIG. 10 is a graph comparing strength of inductors according to an exemplary embodiment and a comparative example of the related art.

Referring to FIG. 10, the exemplary embodiment illustrates a case in which a protective layer including ceramic grains having a grain size greater than a grain size of a body is disposed on a surface of the body according to an exemplary embodiment, and the comparative example illustrates a case of the related art in which a protective layer is not disposed on a surface of a body.

As illustrated in the graph of FIG. 10, in the exemplary embodiment in which the protective layer including the ceramic grain having a grain size greater than a grain size of the body is disposed on a surface of the body, it may be seen that the strength of the inductor has been improved as compared with the comparative example.

As set forth above, according to an exemplary embodiment, an inductor may be provided having improved reliability and excellent frequency characteristics by providing a protective layer on a surface of a body and by adjusting a grain size in the protective layer to be greater than a grain size in the body.

In detail, as an inner grain size of the protective layer after sintering may be adjusted to be greater than a grain size in the body, the penetration of a plating solution may be prevented and the strength of a body may be improved due to the protective layer having a relatively great grain size. Further, as the stress may be relieved in the inside of the body due to the relatively small grain size therein, frequency characteristics may be improved.

In addition, by adjusting a grain size of a cover portion disposed in the body to be greater than a grain size in an active portion, the stress between the cover portion and the active portion may be relieved, and thus, the impedance characteristic of the inductor may be improved.

While exemplary embodiments have been shown and described above, it will be apparent to those skilled in the art that modifications and variations could be made without departing from the scope of the present invention as defined by the appended claims.

What is claimed is:

1. An inductor comprising:

a body having a coil portion disposed therein; and a protective layer disposed on a surface of the body, wherein the body includes an active portion in which a coil portion is disposed, and a cover portion disposed on upper and lower surfaces of the coil portion such that the protective layer is spaced apart from the coil portion by the cover portion, a grain size, in the protective layer spaced apart from the coil portion by the cover portion, is greater than a grain size in the cover portion of the body, and the grain size in the protective layer is 1.5 μm or more.

2. The inductor of claim 1, wherein the grain size in the body is 1.5 μm or less.

3. The inductor of claim 1, wherein the protective layer has an average thickness of 10 μm to 20 μm.

4. The inductor of claim 1, wherein a grain size in the cover portion is greater than a grain size in the active portion.

5. The inductor of claim 1, wherein a porosity of the cover portion is lower than a porosity of the active portion.

6. The inductor of claim 1, wherein the protective layer is disposed on both sides of the body in a width direction and on upper and lower surfaces of the body in a thickness direction.

7. The inductor of claim 1, wherein the protective layer is disposed on all surfaces of the body.

8. The inductor of claim 7, wherein one end and another end of the coil portion penetrate through the protective layer and are exposed externally of the body.

9. The inductor of claim 1, further comprising an external electrode disposed on an external surface of the body to be connected to an end of the coil portion, wherein the protective layer, the active portion, and the cover portion in the body comprise a ceramic material.

10. The inductor of claim 1, wherein a grain size (Ga) in the active portion, a grain size (Gb) in the cover portion, and a grain size (Gc) in the protective layer satisfy $Ga<Gb<Gc$.

11. The inductor of claim 1, wherein a porosity of the protective layer is lower than a porosity of the body.

12. The inductor of claim 1, wherein the body has a hexahedral shape, and the protective layer entirely covers at least four surfaces of the body.

13. The inductor of claim 1, wherein the grain size in the protective layer is greater than the grain size in the cover portion, and the grain size in the cover portion is greater than a grain size of the active portion.

14. The inductor of claim 1, wherein the cover portion contacts the coil.

15. The inductor of claim 1, wherein the ceramic material of the protection layer is the same as the ceramic material of the body.

16. An inductor comprising:

a body having a coil portion disposed therein; and a protective layer disposed on a surface of the body, wherein the body includes an active portion in which a coil portion is disposed, and a cover portion disposed on upper and lower surfaces of the coil portion, a grain size in the protective layer is greater than a grain size in the body, a porosity of the protective layer is lower than a porosity of the body, and the grain size in the protective layer is 1.5 μm or more.

17. The inductor of claim 16, wherein the grain size in the body is 1.5 μm or less.

18. The inductor of claim 16, wherein the protective layer has an average thickness of 10 μm to 20 μm.

19. The inductor of claim 16, wherein a grain size in the cover portion is greater than a grain size in the active portion.

20. The inductor of claim 16, wherein a porosity of the cover portion is lower than a porosity of the active portion.

21. The inductor of claim 16, wherein the protective layer is disposed on both sides of the body in a width direction and on upper and lower surfaces of the body in a thickness direction.

22. The inductor of claim 16, wherein the protective layer is disposed on all surfaces of the body.

23. The inductor of claim 22, wherein one end and another end of the coil portion penetrate through the protective layer and are exposed externally of the body.

24. The inductor of claim 16, further comprising an external electrode disposed on an external surface of the body to be connected to an end of the coil portion, wherein the protective layer, the active portion, and the cover portion in the body comprise a ceramic material.

25. The inductor of claim 16, wherein a grain size (Ga) in the active portion, a grain size (Gb) in the cover portion, and a grain size (Gc) in the protective layer satisfy $Ga<Gb<Gc$.

26. The inductor of claim 16, wherein the body has a hexahedral shape, and the protective layer entirely covers at least four surfaces of the body.

27. The inductor of claim 16, wherein the cover portion contacts the coil.

28. The inductor of claim 16, wherein the ceramic material of the protection layer is the same as the ceramic material of the body.

* * * * *